US009655443B2

(12) United States Patent
Cano et al.

(10) Patent No.: US 9,655,443 B2
(45) Date of Patent: May 23, 2017

(54) ADJUSTABLE SHELF SUPPORT SYSTEM FOR MEDICINE CABINETS

(71) Applicant: American Glass Crafter, Inc., Carldstadt, NJ (US)

(72) Inventors: Joseph Fernando Cano, Ridgewood, NJ (US); Michael Balagyozyan, Wanye, NJ (US)

(73) Assignee: American Glasscrafters, Inc., Carlstadt, NJ (US)

( * ) Notice: Subject to any disclaimer, the term of this patent is extended or adjusted under 35 U.S.C. 154(b) by 0 days.

(21) Appl. No.: 14/332,742

(22) Filed: Jul. 16, 2014

(65) Prior Publication Data

US 2016/0015176 A1 Jan. 21, 2016

(51) Int. Cl.

| | |
|---|---|
| ***A47G 29/02*** | (2006.01) |
| ***E04G 3/20*** | (2006.01) |
| ***E06B 7/28*** | (2006.01) |
| ***A47B 96/06*** | (2006.01) |
| ***A47B 57/40*** | (2006.01) |
| ***A47B 67/02*** | (2006.01) |
| *A47G 29/18* | (2006.01) |

(Continued)

(52) U.S. Cl.

CPC ..... *A47B 57/404* (2013.01); *A47B 57/40* (2013.01); *A47B 57/48* (2013.01); *A47B 67/02* (2013.01); *A47B 96/062* (2013.01); *A47B 57/30* (2013.01); *A47B 57/482* (2013.01); *A47B 57/485* (2013.01); *A47B 57/487* (2013.01); *A47B 57/50* (2013.01); *A47B 96/061* (2013.01); *A47B 96/063* (2013.01); *A47B 96/068* (2013.01)

(58) Field of Classification Search

CPC ..... A47B 57/42; A47B 96/061; A47B 96/00; A47B 96/028; A47B 57/40; A47B 96/068; A47B 88/044; A47B 96/06; A47B 96/063; A47B 57/30; A47B 57/56; A47B 57/34; A47B 57/48; A47B 57/482; A47B 57/485; A47B 57/487; A47B 57/50

USPC ..... 248/253, 241, 243, 245, 250; 312/226, 312/242, 315, 116, 126, 128, 351, 408; 211/134; 108/106–109

See application file for complete search history.

(56) References Cited

U.S. PATENT DOCUMENTS 1,062,901 A * 5/1913 Entwistle ..... A47B 57/42 248/243

2,266,206 A 12/1941 Jackson (Continued)

FOREIGN PATENT DOCUMENTS

FR 2672480 8/1992

*Primary Examiner* — Brian Mattei
*Assistant Examiner* — Taylor Morris
(74) *Attorney, Agent, or Firm* — Richard Malagiere, Esq.

(57) ABSTRACT

An adjustable locking shelf support system for use in a medicine cabinet or other cabinet. The adjustable shelf support members have set-off lugs which are inserted and locked into slots in a recessed race located in the vertical walls of the cabinet. The front portion of the adjustable locking shelf support member protrudes into the cabinet toward the front has a channel that, together with the cooperating adjustable locking shelf support member located on the opposite side vertical wall of the cabinet, accepts a shelf made of glass or other material. The adjustable shelf support members can be removed and replaced throughout the cabinet in other slots evenly spaced in a vertical orientation in the recessed race of the vertical walls of the cabinet.

2 Claims, 2 Drawing Sheets

(51) Int. Cl.

| | |
|---|---|
| *A47G 29/24* | (2006.01) |
| *A47K 1/00* | (2006.01) |
| *A47K 5/00* | (2006.01) |
| *B44D 3/12* | (2006.01) |
| *B67B 5/00* | (2006.01) |
| *B67B 5/06* | (2006.01) |
| *E04G 3/00* | (2006.01) |
| *F16L 3/08* | (2006.01) |
| *E04G 5/06* | (2006.01) |
| *F21V 21/00* | (2006.01) |
| *F21V 35/00* | (2006.01) |
| *F16M 11/00* | (2006.01) |
| *A47F 5/00* | (2006.01) |
| *A47B 88/00* | (2017.01) |
| *A47B 95/00* | (2006.01) |
| *A47B 96/04* | (2006.01) |
| *A47B 57/50* | (2006.01) |
| *A47B 57/48* | (2006.01) |
| *A47B 57/30* | (2006.01) |

(56) References Cited

U.S. PATENT DOCUMENTS

| | | | | |
|---|---|---|---|---|
| 2,345,269 | A | 3/1944 | Lackey | |
| 2,354,269 | A * | 7/1944 | Marchand | 248/243 |
| 3,029,056 | A * | 4/1962 | Breglia | 248/243 |
| 3,471,112 | A | 10/1969 | MacDonald | |
| 3,765,344 | A * | 10/1973 | Ferdinand et al. | 108/108 |
| 4,201,139 | A | 5/1980 | Suttles | |
| 4,411,400 | A | 10/1983 | Everett | |
| 4,676,469 | A * | 6/1987 | Rotermund | A47B 96/1416 248/243 |
| 4,856,746 | A * | 8/1989 | Wrobel | A47B 96/068 108/107 |
| 4,929,116 | A * | 5/1990 | Mahl | A47B 43/02 108/108 |
| 5,135,194 | A | 8/1992 | Laughon | |
| 5,195,708 | A | 3/1993 | Marsh | |
| 5,199,584 | A * | 4/1993 | Fowler et al. | 211/184 |
| 5,695,163 | A | 12/1997 | Tayar | |
| 6,273,534 | B1 * | 8/2001 | Bueley et al. | 312/334.8 |
| 6,315,134 | B1 * | 11/2001 | Stuart | 211/87.01 |
| 6,464,186 | B1 | 10/2002 | Marsh | |
| 6,669,029 | B1 * | 12/2003 | Beane | 211/26 |
| 6,776,466 | B2 | 8/2004 | Harvie, III | |
| 6,817,688 | B2 * | 11/2004 | O'Halloran | A47B 96/063 108/108 |
| 7,497,533 | B2 * | 3/2009 | Remmers | 312/404 |
| 8,042,892 | B2 * | 10/2011 | Benz | A47B 57/562 108/108 |
| 9,211,004 | B2 | 12/2015 | Diemel, Jr. | |
| 2004/0069730 | A1 * | 4/2004 | Woods | 211/74 |
| 2005/0103733 | A1 * | 5/2005 | Saltzberg et al. | 211/187 |
| 2007/0045210 | A1 * | 3/2007 | Richardson | A47B 57/42 211/187 |
| 2011/0149508 | A1 * | 6/2011 | Malekmadani | 361/679.48 |

* cited by examiner

ADJUSTABLE SHELF SUPPORT SYSTEM FOR MEDICINE CABINETS

FIELD OF INVENTION

The present invention relates to a shelving system for a medicine cabinet which provides for adjustability of the shelf support members while also providing for stiffness in these members. Specifically, a recessed race is provided in the inside vertical wall of the medicine cabinet into which circular slots are cut. The circular slots provide a receptacle into which the shelf support members can be removably inserted and locked into place. Once in place, the shelf support member portion protruding toward the front of the medicine cabinet, provides a channel which acts as a support for glass, or other material, to act as a shelf in the medicine cabinet.

BACKGROUND OF THE INVENTION

Medicine cabinets often provide a mechanism to adjust and relocate the shelves in the cabinet. This mechanism often takes the form of holes drilled or punched into the side wall of the medicine cabinet box structure. Several different methods of inserting the shelf support are used. The common pin and hole arrangement is often employed in several variations. This method often provides for an unsteady shelf that may become tilted due to several factors. First, the shelf may become tilted if the shelf experiences an unevenly distributed load over a period of time. Second, the shelf may become unsteady or tilted based upon the tolerance of the fit between the pin and hole becoming too loose caused by repeated placement and replacement of shelves in different locations over time and/or poor manufacturing tolerances. Further, this arrangement often provides for two rows of evenly spaced vertical holes on the side wall of the medicine cabinet to accept the shelf supports in varying locations. These unused holes are unsightly based upon the fit of the shelf support pin and the hole into which it fits.

Accordingly, it is the object of the present invention to provide an adjustable cabinet shelf support system which exhibits rigidity and strength, ease of adjustment and esthetic appeal. The present invention provides for adjustable shelf holding members containing securing lugs to lock into circular slots provided in the vertical shelf side walls of the cabinet. The vertically arranged circular slots are spaced out in a vertical orientation and located in a recessed race feature provided in the vertical side walls of the cabinet. This arrangement provides for the rigidity in that each shelf holding member is secured by at least two lugs and esthetic appeal because the unused circular slots are hidden in the recessed race feature of the vertical side walls of the cabinet. Further, the portion of the adjustable shelf holding members which extends inside the cabinet box toward the front contains an open channel which forms an insert to receive glass or other material to be inserted as a shelf in the cabinet.

SUMMARY OF THE INVENTION

An adjustable shelf support system for medicine cabinets, or other similar cabinet structures, which provides rigid easily adjustable shelving supports which accept glass or other shelving materials once locked into place in the cabinet structure. Each shelf support member is manufactured with at least two lugs which fit into circular slots vertically arranged on the vertical side walls of the cabinet. The shelf support members are arranged when inserted on the vertical walls of the cabinet so as to align the channels in the front portion of the shelf support member which protrudes into the cabinet toward the front to form an insert to accept a shelf made of glass or other material in a level orientation. The circular slots arranged in the vertical inside side wall of the cabinet are located in a recessed race so the unused slots are not visible.

DETAILED DESCRIPTION OF THE INVENTION

Figure 1:
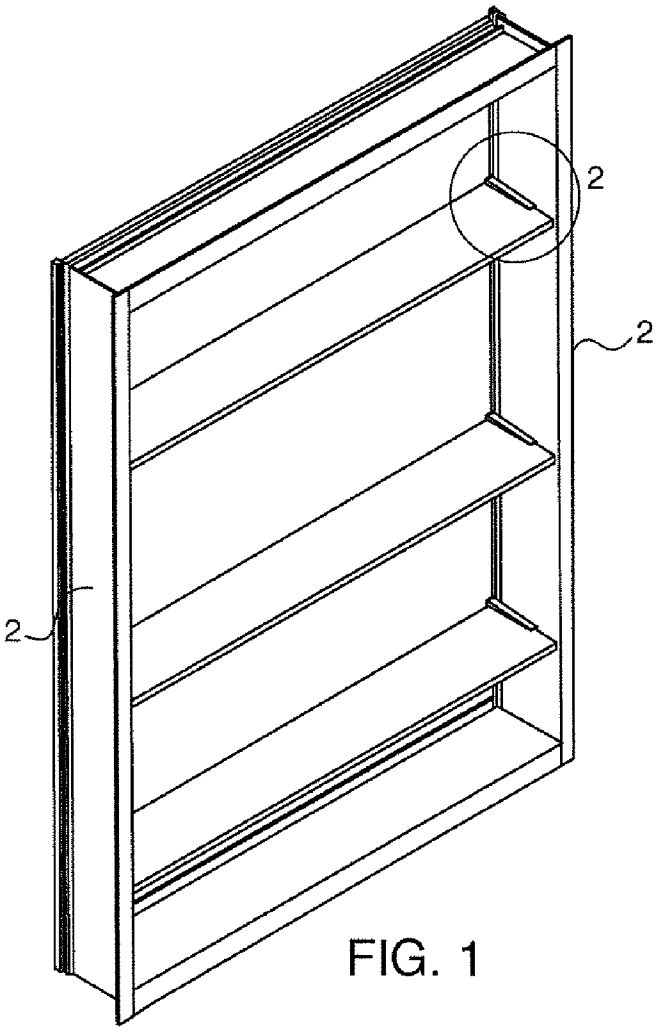
FIG. 1. is an isometric view of a cabinet showing the present invention installed.

The present invention will now be described in terms of the presently preferred embodiment thereof as illustrated in the drawings. Those of ordinary skill in the art will recognize that many obvious modifications may be made thereto without departing from the spirit or scope of the present invention.

Figure 2:
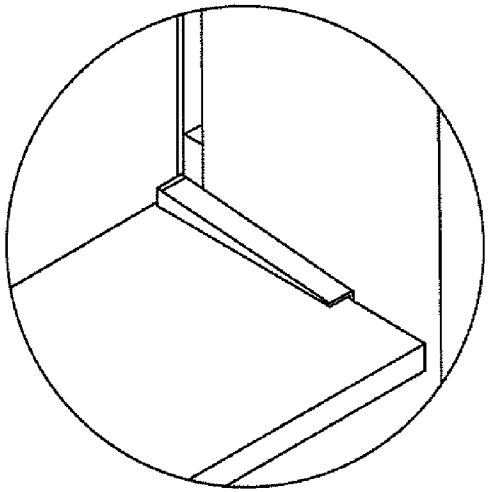
FIG. 2. is an exploded view of a detail in FIG. 1.
Figure 3:
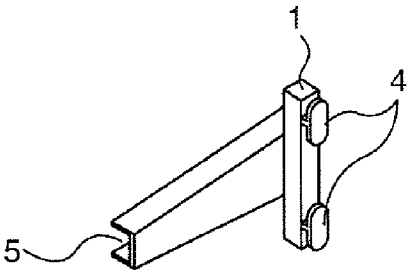
FIG. 3. is an isometric view of the adjustable shelf support member with locking lugs depicted.
Figure 7:
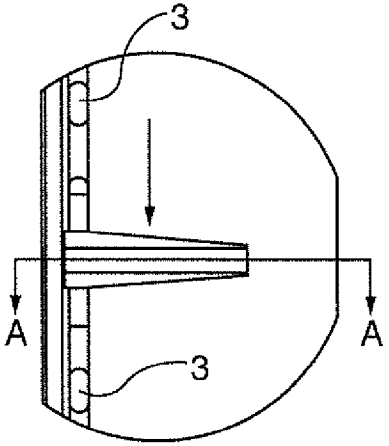
FIG. 7. is a side view of the inside vertical cabinet wall recessed race feature depicting the vertically spaced apertures and showing an installed adjustable shelf support member.
Figure 6:
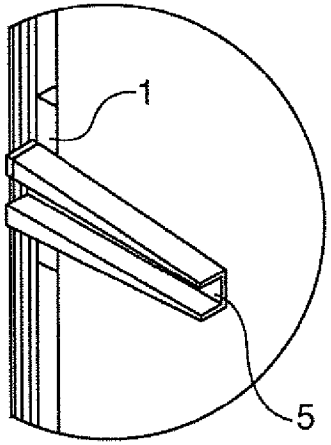
FIG. 6. is an exploded view of the inserted adjustable shelf support member inserted into the recessed race feature of the inside vertical cabinet wall.
Figure 5:
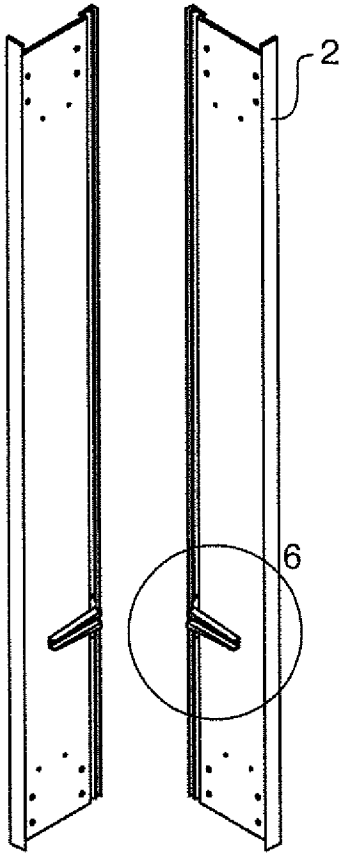
FIG. 5. is an isolated view of the vertical cabinet walls showing the recessed race feature and an adjustable shelf support member inserted.

The present invention is directed to a system for locking adjustable shelf support members into a medicine cabinet or other general purpose cabinet and then inserting a shelf in the insert created by the channel feature of the front portion of the support members which protrude toward the front of the cabinet. FIG. 1. In the present preferred embodiment, each adjustable shelf support 1 features at least two lugs 4 which slide and lock into circular slots arranged into a recessed race in the vertical walls of the cabinet 2 into which it is installed. FIG. 3, FIG. 5 and FIG. 6. The vertical walls of the cabinet 2 are parallel. Each vertical wall 2 has a race machined or molded into it toward the back end of the cabinet structure in which the vertical walls provide the vertical frame members. FIG. 2 and FIG. 5. Circular slots 3 are punched, machined or molded into the recessed race of the cabinet and arranged evenly in vertical orientation on both vertical walls of the cabinet. FIG. 1 and FIG. 7. Specifically, the circular slots 3 are arranged so that when the cabinet is assembled with all four walls (i.e., both vertical walls connected to both horizontal walls) the location of each circular slot measured from either the top horizontal member or the bottom horizontal member is the same for both vertical walls of the cabinet. FIG. 1. As such, the corresponding adjustable shelf support members 1 inserted into the circular slots 3 on the vertical walls 2 of the cabinet will be the same distance from the horizontal base or top of the cabinet.

Figure 4:
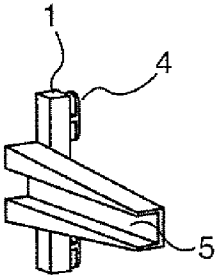
FIG. 4. is an isometric view of the adjustable shelf support member with the shelf receiving channel depicted.
Figure 9:
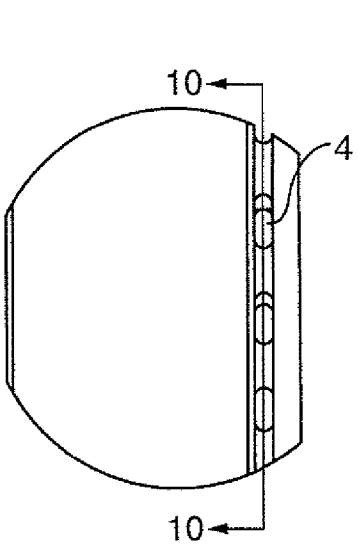
FIG. 9. is a side view of the outside vertical cabinet wall race feature depicting the vertically spaced apertures and showing the lugs of adjustable shelf support member.

The adjustable shelf support members 1 when inserted into the vertical walls of the cabinet 2 contain a portion which protrudes inside and toward the front of the cabinet. FIG. 3 and FIG. 4. A channel feature 5 is machined or molded into the protruding portion of the shelf support member 1. FIG. 4 and FIG. 6. The channel feature 5 in two adjustable shelf support members 1 inserted opposite each other in the vertical walls 2 of the cabinet form an insert into which a shelf made of glass or any other material can be slid into and stationed within the cabinet. FIG. 2. Shelves can be inserted throughout the cabinet this same way in any spacing configuration which the user desires limited, of course, by the available space in the cabinet. FIG. 1.

Figure 8:
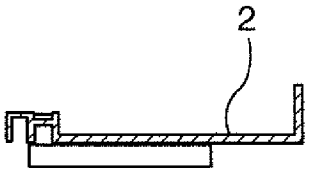
FIG. 8. is a section cut view along axis AA of FIG. 7.

The lug •features 4 on the adjustable shelf support members 1 are machined or molded such that the lugs stand-off of the shelf support member body 1. FIG. 3. The lugs 4 are machined or molded such that their outer planner configuration is the same geometrically as the circular slot 3 into which each lug 4 is to be inserted; the dimensions, however, of the lugs 4 are slightly smaller than the circular slots 3 in the vertical walls of the cabinet 2 into which the lugs are to be inserted. FIG. 3. This allows the lugs 4 to freely fit into and pass through the circular slots 3 in the vertical cabinet walls 2 such that the body of each shelf support member 1 is flush against the inner vertical cabinet wall recessed race when the lugs are inserted into the circular slots 3 in the vertical cabinet wall recessed race. FIG. 2. At this point, the shelf support member 1 is pushed downward (as shown in FIG. 7) so that the body of the shelf support member is wedged against the inner face of the recessed race of the vertical wall 2 while the front and back of the body of the shelf support member is wedged between the front and back faces of the recessed race of the inner vertical wall. FIG. 2 and FIG. 8. Further, the protruding portion of the shelf support member, 5, is frictionally in contact with the inner face of the vertical wall 2. FIG. 6. The downward motion also works to wedge the inside face of the lugs of the shelf support member against the outside face of the vertical wall on the opposite side of the recessed race feature. FIG. 2. This wedging works to lock the adjustable support members 1 into place in the direction of the load that will be applied to the shelf secured by the shelf support member. In this way, the load applied by placing items on the shelf supported by the adjustable support members 1 will work to further wedge the adjustable support members into place and reinforce the adjustable support member's stiffness.

Notwithstanding, the shelf support members 1 can be removed from their wedged positions and replaced in other positions throughout the cabinet limited only by the locations of the circular slots 3 on the vertical walls of the cabinet. FIG. 1 and FIG. 7. The shelf support members 1 can be molded or fabricated from materials impregnated with a lubricating property (such as oil) to allow for ease of extraction and replacement throughout the cabinet.

Once the shelf support members 1 are locked into place on matching circular slots 3 on each side of the vertical walls of the cabinet 2, then a shelf, made of glass or other material, is slid into the channel 5 formed in the front portion of each of the shelf support members facing the opening of the cabinet. FIG. 1. and FIG. 2. The channels 5 provide for an opening which allows the shelf to be oriented level with the horizontal walls of the cabinet. Of course, this can be done numerous times throughout the cabinet limited only be the available slots in the cabinet vertical wall along with the user's desired spacing between shelves.

Those of ordinary skill in the art will recognize that the embodiments just described merely illustrate the principles of the present invention. Many obvious modifications may be made thereto without departing from the spirit or scope of the invention as set forth in the appended claims.

What is claimed is:

1. An adjustable shelf support locking system for a cabinet with two generally parallel inner vertical walls, comprising:

A pair of shelf support locking members each having an elongated rectangular body section with four sides and a plurality of attachment lugs standing off perpendicular from the side of the elongate rectangular body that slides against a side wall surface of a recessed race formed in each of the inner vertical walls of the cabinet for insertion into circular slots in the vertical inner wall of the cabinet;

Each shelf support locking member having a generally triangular section protruding from the side opposite the attachment lugs on the elongated rectangular body section containing a channel opening portion oriented to receive a shelf;

The recessed race formed in each of the inner vertical walls of the cabinet having front, back and side wall surfaces, the side wall surface having circular slots formed in a recessed surface and evenly spaced in vertical orientation to accept a plurality of lugs protruding from the rectangular body section of each shelf support locking member;

The attachment lugs of each shelf support locking member inserted into and through the circular slots in the recessed race in the vertical wall of the cabinet so that the shelf support locking member lugs are slidingly engaged within the circular slots of the recessed race side wall of the inner vertical wall of the cabinet, the generally triangular section is slidingly engaged against the inner vertical wall of the cabinet and the elongated rectangular body section is slidingly engaged against the front, back and side walls of the recessed race and locked into place;

The shelf support locking members inserted in opposite positions to each other in the inner vertical walls of the cabinet so that the channel opening portion of the shelf support locking members is open to the front of the cabinet and together form an insert into which a shelf is inserted.

2. An adjustable shelf support locking system as set forth in claim 1, further comprising two lugs attached to the rectangular body.

* * * * *